US005219091A

United States Patent [19]

Paramski

[11] Patent Number: 5,219,091

[45] Date of Patent: Jun. 15, 1993

[54] DISPENSING FOOD CONTAINER

[76] Inventor: Walter P. Paramski, 31401 N. O Plain Rd., Libertyville, Ill. 60048

[21] Appl. No.: 918,641

[22] Filed: Jul. 21, 1992

[51] Int. Cl.[5] ..... B65D 83/00

[52] U.S. Cl. ..... 220/580; 222/320; 222/386

[58] Field of Search ..... 220/216, 219, 221, 222, 220/224, 227, 580; 222/135, 145, 319, 320, 386

[56] References Cited

U.S. PATENT DOCUMENTS

| | | | |
|---|---|---|---|
| D. 276,118 | 10/1984 | Conti et al. . | |
| D. 287,919 | 1/1987 | Clements . | |
| 1,603,013 | 10/1926 | Bagley | 222/320 |
| 1,973,449 | 9/1934 | Tighe . | |
| 2,309,446 | 1/1943 | Ekkebus | 222/386 X |
| 2,684,791 | 7/1954 | Sebell | 222/386 |
| 2,763,405 | 9/1956 | Shvetz | 222/320 |
| 2,812,121 | 11/1957 | Sheets . | |
| 2,915,225 | 12/1959 | Atkins | 222/320 |
| 3,249,265 | 5/1966 | Wershaw et al. | 222/320 |
| 3,987,941 | 10/1976 | Blessing | 222/386 |
| 4,905,872 | 3/1990 | Fischer | 222/145 |
| 5,037,009 | 8/1991 | Shea | 222/386 |

*Primary Examiner*—Gary E. Elkins
*Assistant Examiner*—Nova Stucker
*Attorney, Agent, or Firm*—Speckman & Pauley

[57] ABSTRACT

A dispensing food container having a bottom wall and a side wall connected to the bottom wall, thereby forming an inner chamber. A cover is displaceably mounted with respect to the side wall for varying the volume of the inner chamber. At least a portion of an outer peripheral portion of the cover forms a seal against an inner surface of the side wall. The cover has a cover through hole which is in communication with the inner chamber. A flanged nozzle can be used to facilitate transfer of the fluidized food from within the inner chamber to a cracker, a chip, a vegetable or the like.

12 Claims, 2 Drawing Sheets

DISPENSING FOOD CONTAINER

BACKGROUND OF THE INVENTION

1. Field of the Invention

This invention relates to a container for dispensing food wherein a cover of the container is forced toward a bottom of the container and results in a fluidized food being forced upward and through a cover through hole within the cover.

2. Description of Prior Art

Many food containers exist which hold fluidized food, such as various dips for chips, vegetables and the like. However, most conventional food containers require the user to scoop the food out with an utensil, such as a spoon, knife or the like. Other containers for food have various covers or lids for preserving the food during storage. Some conventional lids are for the purpose of retaining heat or preventing spillage of the fluidized food.

For example, U.S. Pat. Des. 287,919 discloses a drinking cup lid which has a relatively small through hole in the lid for allowing liquid within the drinking cup to flow from the cup, through the lid and into a special reservoir molded within the lid.

U.S. Pat. No. 2,812,121 teaches a dispensing container for liquids, powder, sugar and the like. The protective cover for the container has a flange with a cut away section. By squeezing or applying pressure about the periphery of the container, the container extends in a predetermined direction to form a spout through which liquid within the container can be poured. The spout extends through the cut away section of the lid when the container is compressed about its periphery.

U.S. Pat. No. 1,973,449 and Des. 276,118 disclose different covers for dishes or the like. According to the teachings of the '449 patent, the cover has openings for the exhaust of steam or vapor.

It is thus apparent that there exists a need for a container which provides easy dispensing of a fluidized food, such as dips for vegetables, chips, crackers and the like, particularly without requiring additional utensils for dispensing the food.

SUMMARY OF THE INVENTION

It is one object of this invention to provide a container for dispensing fluidized food in a sanitary manner.

It is another object of this invention to provide a container for dispensing food wherein a suitably designed flange is used to accommodate transfer of the fluidized food from the container to a chip, a cracker, a vegetable or the like.

It is still another object of this invention to provide a dispensing food container which prevents excessive spillage or waste of the food during the dispensing operation.

The above and other objects of this invention are accomplished with a dispensing food container having a bottom wall and a side wall which is connected to the bottom wall, thereby forming an inner chamber. A cover is displaceably mounted with respect to the side wall for varying the volume of the inner chamber. At least a portion of an outer peripheral portion of the cover forms a seal against the inner surface.

According to one preferred embodiment of this invention, such seal is formed with a flexible sealing strip which is secured to an extending radially outward from the outer peripheral portion of the cover. In another preferred embodiment according to this invention, the seal is formed by the cover having a reduced thickness, in a radially outward direction.

The cover has a cover through hole which is in communication with the inner chamber. The fluidized food flows from the inner chamber through the cover through hole when pressure is applied to the cover, so as to reduce the volume of the inner chamber.

According to one preferred embodiment of this invention, a nozzle is sealably secured to the cover. The nozzle has a nozzle opening which is in communication with the cover through hole. A flange is preferably secured to the nozzle. The flange has a flange through hole which is in communication with the nozzle opening and thus in communication with the inner chamber. It is apparent that the flange can be secured directly to or integrally formed with the cover so that the nozzle section is not necessary.

According to one preferred embodiment of this invention, a bottom insert is positioned within the inner chamber. The bottom insert preferably but not necessarily has a convex surface which is generally mateable with a generally concave inner surface of the cover. The concave inner surface of the cover faces the inner chamber. In one preferred embodiment of this invention, the bottom insert is integrally formed with the bottom wall. According to yet another preferred embodiment of this invention, the bottom insert has a male extension which is preferably aligned with and generally mateable within the cover through hole, for forcing all of the fluidized food out of the inner chamber, without wasting a portion of the fluidized food.

It is apparent that the components of this invention can be injection molded with a plastic or other polymeric material. It is also apparent that many basic components of this invention can be integrally formed with each other or can be separately formed and still accomplish the same result of this invention.

BRIEF DESCRIPTION OF THE DRAWINGS

This invention and the above and other objects of this invention will become more apparent when the specification is taken in view of the drawings, wherein.

DESCRIPTION OF PREFERRED EMBODIMENTS

Figure 1:
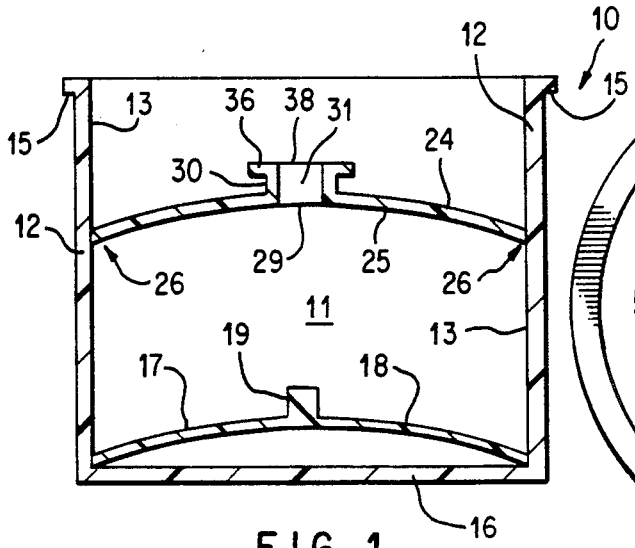
FIG. 1 is a cross-sectional view, taken through the center of a food dispensing container, according to one preferred embodiment of this invention.
Figure 2:
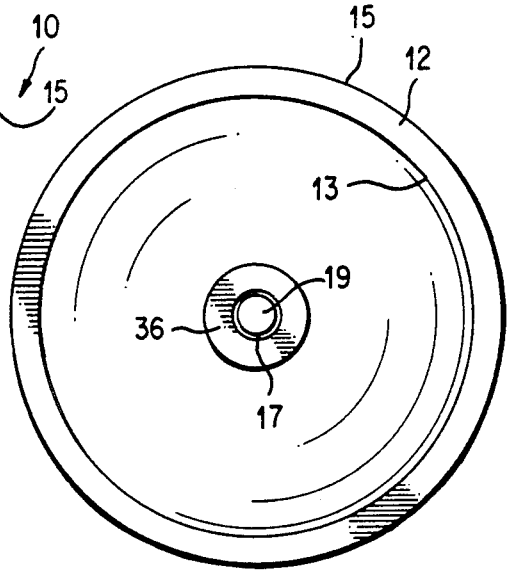
FIG. 2 is a top view of the food dispensing container, as shown in FIG. 1.

Referring to FIGS. 1 and 2, which show food dispensing container 10, according to one preferred embodiment of this invention, container 10 comprises side wall 12 which is connected to bottom wall 16, thereby forming inner chamber 11. It is apparent that side wall 12 and bottom wall 16 form a cylindrical container, as shown in FIG. 1. However, it is also apparent that side wall 12 and bottom wall 16 can form other suitably shaped containers which may not necessarily have a circular cross-section. Side wall 12 has inner surface 13.

Cover 24 is displaceably mounted with respect to side wall 12. As shown in FIG. 1, cover 24 can move in a vertical direction, approximately parallel to side wall 12, for varying the volume of inner chamber 11. By reducing the volume of inner chamber 11, it is apparent that the fluidized food or other fluid within inner chamber 11 will find its path of least resistance and thus flow through cover through hole 29 of cover 24. Once the fluidized food is discharged from cover through hole 29, it is apparent that a chip, a cracker, a vegetable or the like can be used to scrape the fluidized food as it is discharged from cover through hole 29.

It is apparent that cover 24 preferably forms a seal with respect to inner surface 13, at outer peripheral portion 26 of cover 24. In one preferred embodiment according to this invention, cover 24 is sealed with respect to inner surface 25 about the entire periphery of cover 24. It is also apparent that according to other preferred embodiments of this invention, cover 24 need only be sealed with respect to inner surface 13 about a portion of the periphery of cover 24.

Cover 24 has at least one cover through hole 29 which is in communication with inner chamber 11. FIGS. 7A-7F show various embodiments of the possible configurations for cover through hole 29. It is apparent that other suitably shaped cover through holes 29 can be used at various positions about cover 24 to accomplish the same result of this invention, allowing fluidized food to pass from inner chamber 11 and through cover through hole 29.

In one preferred embodiment according to this invention, nozzle 30 is sealably secured to cover 24. Nozzle 30 has nozzle opening 31 which is in communication with cover through hole 29 and thus inner chamber 11. Flange 36, which defines flange through hole 38, is preferably secured to nozzle 30, such that flange through hole 38 is in communication with nozzle opening 31 and thus inner chamber 11. It is apparent that if and when used, flange 36 can be secured directly to cover 24 and thus eliminate the need for nozzle 30. According to one preferred embodiment of this invention, flange 36, cover 24, and when used, nozzle 30, are injection molded as one integral piece.

Figure 6:
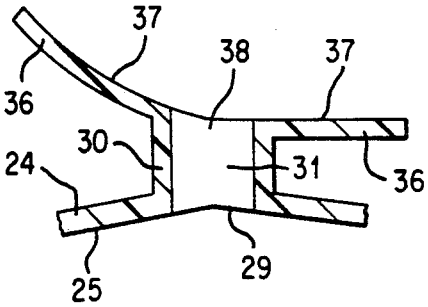
FIG. 6 is an enlarged cross-sectional view of a flange, a nozzle and the cover, according to one preferred embodiment of this invention.
Figure 7A:
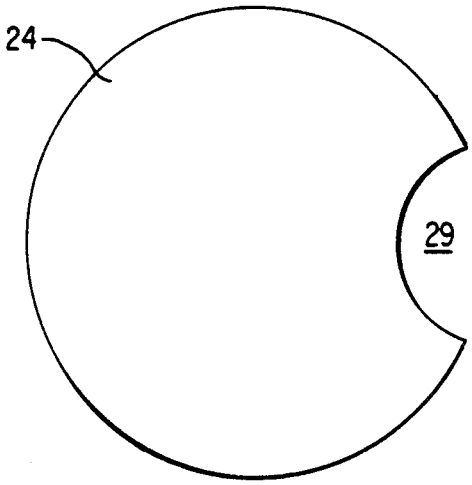
FIGS. 7A–7F each show a top view of a cover of this invention, each according to one preferred embodiment.
Figure 7B:
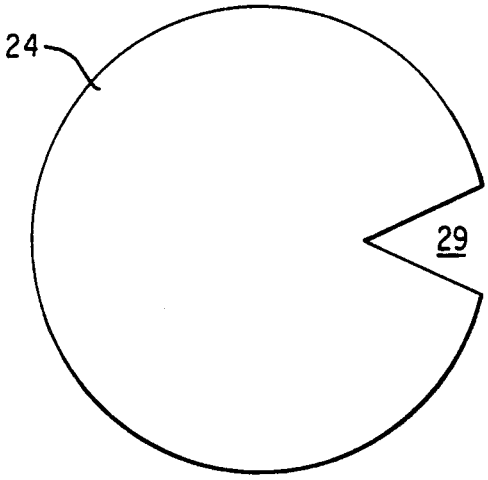
Figure 7C:
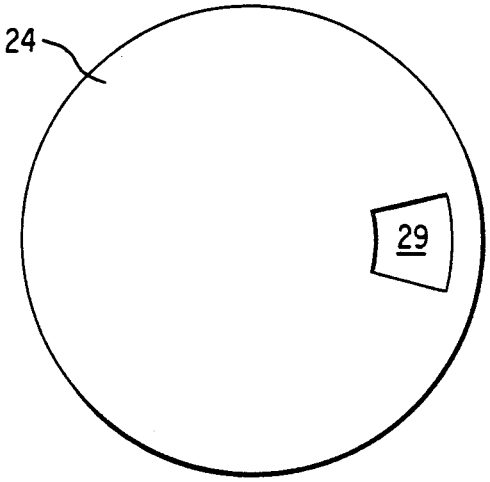
Figure 7D:
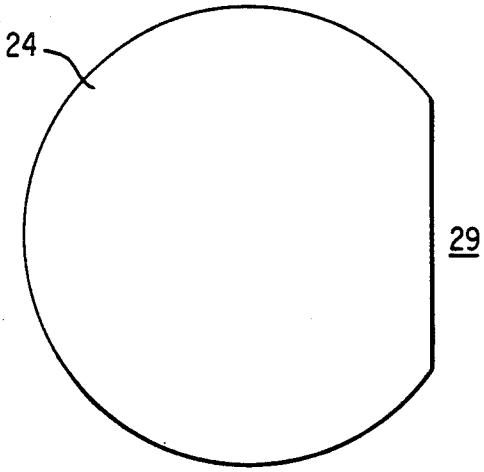
Figure 7E:
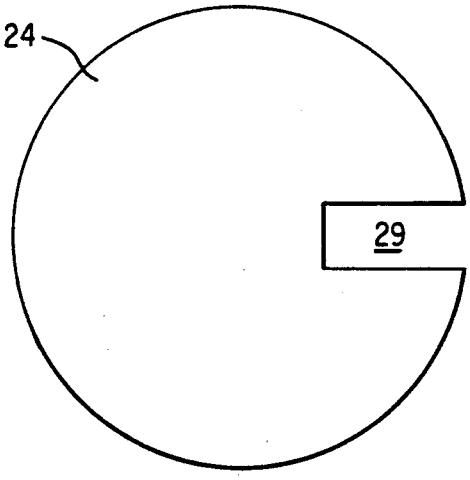
Figure 7F:
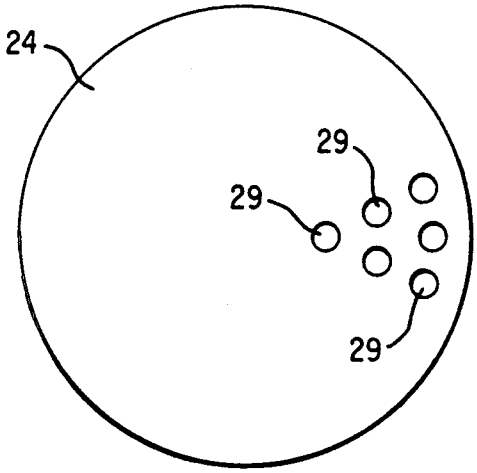

As shown in FIG. 6, flange 36 preferably forms scraping surface 37 in a concave fashion. Such concave surface facilitates transfer of the fluidized food from scraping surface 37 to the chip, cracker, vegetable or the like. However, it is apparent that any suitably shaped scraping surface 37 can be formed, depending upon the particular use of this invention.

Figure 3:
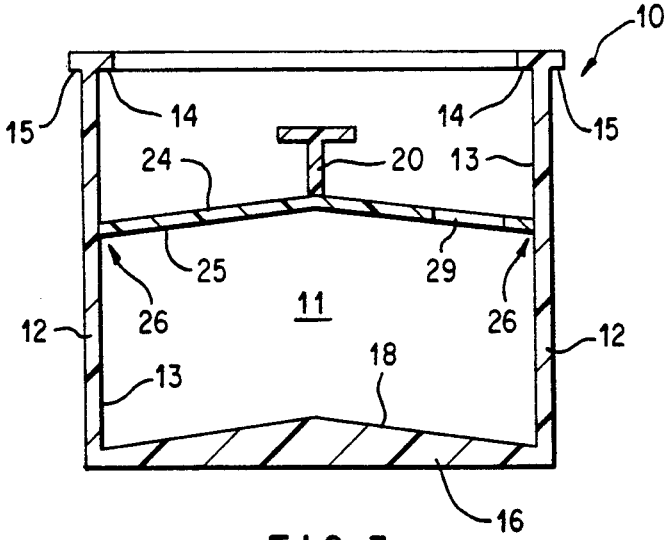
FIG. 3 is a cross-sectional view, taken along the center of a dispensing food container, according to another preferred embodiment of this invention.

According to one preferred embodiment of this invention, as shown in FIG. 1, bottom insert 17 is positioned within inner chamber 11. Bottom insert 17 preferably rests against bottom wall 16, as shown in FIG. 1. Bottom insert 17 preferably has generally convex surface 18, which is mateable with the generally concave inner surface 25 of cover 24. Thus, as cover 24 is pushed in a downward direction toward bottom insert 17, cover 24 and bottom insert 17 mate with each other to reduce the volume of inner chamber 11 as far as practically possible to remove as much of the fluidized food as possible. In one preferred embodiment according to this invention, bottom insert 17 and convex surface 18 are integrally formed with bottom wall 16, as shown in FIG. 3. In another preferred embodiment according to this invention, male extension 19 is aligned with and generally mateable within cover through hole 29. Such arrangement further facilitates removal of all of the fluidized food from within inner chamber 11.

It is apparent that male extension 19 can be integrally formed with either bottom insert 17 or bottom wall 16. It is also apparent that male extension 19 can be either integrally formed with or secured to bottom wall 16, for example. Although male extension 19 is shown only in FIG. 1 and not in FIG. 3, it is apparent that a suitably shaped male extension 19 can also be positioned within inner chamber 11, as shown in FIG. 3, to mate with cover through hole 29.

Figure 4:
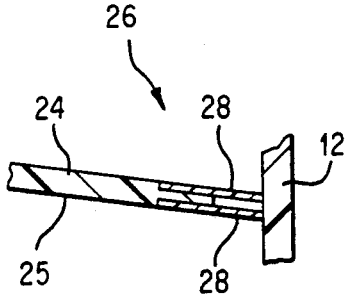
FIG. 4 is an enlarged cross-sectional view of a seal which is formed between a side wall and a cover of the food dispensing container.
Figure 5:
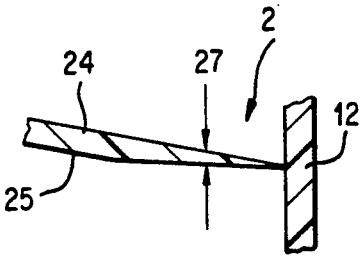
FIG. 5 is an enlarged cross-sectional view, of another preferred embodiment of the seal between the side wall and the cover.

According to one preferred embodiment of this invention, sealing means are used to seal at least a portion of the peripheral edge of outer peripheral portion 26, with respect to inner surface 13 of side wall 12. In one preferred embodiment according to this invention, such sealing means comprise flexible sealing strip 28, as clearly shown in FIG. 4. Each flexible sealing strip 28 is secured to and extends radially outward from outer peripheral portion 26 of cover 24. It is apparent that each flexible sealing strip 28, whether one or more are used, can be secured to cover 24 with a suitable adhesive, by integrally forming such pieces, or by any other suitable connection means known to those skilled in the art. In another preferred embodiment according to this invention, the sealing means comprise outer peripheral portion 26 of cover 24 having reduced thickness 27, as clearly shown in FIG. 5. Regardless of whether the preferred embodiment of FIG. 4 or FIG. 5, or any other suitable arrangement, it is apparent that the sam result of preventing the fluidized food from flowing between side wall 12 and cover 24 is accomplished.

As shown in FIG. 3, handle 20 is secured to cover 24. Handle 20 accommodates the application of force which is necessary to move cover 24 in a downward direction, toward either bottom wall 16 or bottom insert 17. As shown in FIGS. 1 and 2, outer lip 15 is formed about the upper edge of side wall 12, for accommodating any suitably shaped protective cover. As shown in FIG. 3, inner lip 14 is preferably used to prevent cover 24 from being completely withdrawn from container 10.

Regardless of the position of cover through hole 29 and the shape of cover 24 and its corresponding bottom wall 16 or bottom insert 17, this invention provides a simple and extremely sanitary apparatus for dispensing fluidized food, such as dips, cheeses and the like. It is also apparent that with either flange 36 or simply with the outer surface of cover 24, a cracker, chip, vegetable or the like can be used in lieu of a utensil, such as a spoon or the like, to transfer the fluidized food onto the chip, cracker, vegetable or the like.

The components of this invention are preferably constructed from plastic or other polymeric material, since such materials can be injection molded at relatively low costs. However, it is also apparent that other suitable materials can be used for construction of the various components of this invention.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A dispensing food container comprising:

a bottom wall, a side wall connected to said bottom wall forming an inner chamber, said side wall having an inner surface;

a cover displaceably mounted with respect to said side wall for varying a volume of said inner chamber, at least a portion of an outer peripheral portion of said cover forming a seal against said inner surface, and said cover having a cover through hole in communication with said inner chamber; and a flange having a flange through hole, said flange secured with respect to said cover so that said flange through hole is in communication with said cover through hole, said flange having a curved scraping surface extending upward and away from said cover.

2. A dispensing food container according to claim 1 wherein said side wall is integrally formed with said bottom wall.

3. A dispensing food container according to claim 1 further comprising a nozzle sealably secured between and to said cover and said flange, said nozzle having a nozzle opening in communication with said cover through hole and said flange through hole.

4. A dispensing food container according to claim 3, wherein said cover, said nozzle and said flange are integrally formed together.

5. A dispensing food container according to claim 1 further comprising a handle secured to said cover.

6. A dispensing food container according to claim 1 further comprising a flexible sealing strip secured to and extending radially outward from said outer peripheral portion of said cover.

7. A dispensing food container according to claim 1 wherein said outer peripheral portion of said cover has a thickness that reduces in a radially outward direction.

8. A dispensing food container according to claim 1 wherein said cover comprises an inner surface facing said inner chamber and said inner surface is generally concave.

9. A dispensing food container according to claim 8 further comprising a bottom insert positioned within said inner chamber, and said bottom insert having a convex surface generally mateable with said generally concave inner surface.

10. A dispensing food container according to claim 1 wherein a bottom insert is integrally formed with said bottom wall.

11. A dispensing food container according to claim 1 further comprising a bottom insert positioned within said inner chamber.

12. A dispensing food container according to claim 11 wherein said bottom insert further comprises a male extension aligned with and generally mateable within said cover through hole.

* * * * *